US010240440B2

(12) United States Patent
Umphries et al.

(10) Patent No.: US 10,240,440 B2
(45) Date of Patent: Mar. 26, 2019

(54) TOTAL CONTROL PERFORATOR AND SYSTEM

(71) Applicants: Don Umphries, New Iberia, LA (US); Gabe Williger, Dallas, TX (US)

(72) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 152 days.

(21) Appl. No.: 14/756,868

(22) Filed: Oct. 23, 2015

(65) Prior Publication Data

US 2017/0114622 A1 Apr. 27, 2017

(51) Int. Cl.

| | |
|---|---|
| ***E21B 33/12*** | (2006.01) |
| ***E21B 43/117*** | (2006.01) |
| ***E21B 43/119*** | (2006.01) |
| ***E21B 47/00*** | (2012.01) |

(52) U.S. Cl.

CPC ..... *E21B 43/117* (2013.01); *E21B 33/12* (2013.01); *E21B 43/119* (2013.01); *E21B 47/0005* (2013.01)

(58) Field of Classification Search

CPC ..... E21B 43/11; E21B 43/112; E21B 43/116; E21B 43/117; E21B 43/118; E21B 43/119; E21B 47/06; E21B 33/12; E21B 33/13; E21B 33/134; E21B 23/06; E21B 23/14

See application file for complete search history.

(56) References Cited

U.S. PATENT DOCUMENTS

| | | | | | |
|---|---|---|---|---|---|
| 2,760,435 | A * | 8/1956 | Jones | E21B 43/117 | 175/4.52 |
| 3,415,321 | A * | 12/1968 | Venghiattis | E21B 43/117 | 102/310 |
| 3,685,158 | A * | 8/1972 | Planche | E21B 17/1021 | 33/302 |
| 4,557,327 | A * | 12/1985 | Kinley | E21B 17/1021 | 166/172 |
| 4,595,055 | A * | 6/1986 | Vannier | E21B 17/1021 | 166/241.5 |
| 5,111,885 | A | 5/1992 | Umphries | | |
| 5,131,465 | A * | 7/1992 | Langston | E21B 17/1021 | 102/319 |
| 5,295,544 | A * | 3/1994 | Umphries | E21B 43/116 | 166/297 |
| 5,323,684 | A | 6/1994 | Umphries | | |
| 5,472,052 | A | 12/1995 | Head | | |
| 5,507,345 | A | 4/1996 | Wehunt, Jr. et al. | | |
| 6,014,933 | A | 1/2000 | Umphries et al. | | |

(Continued)

*Primary Examiner* — Brad Harcourt
*Assistant Examiner* — David Carroll

(57) ABSTRACT

A shaped charge carrier tool is provided that has particular utility for perforating well casing as a preparation for cement placement. A plurality, four or more elongated shaped charge carrier ribs having a high bending modulus are secured for radially expanded displacement around a central framing tube or rod. Radius rods link the ends of the carrier ribs to top and bottom hinge carriers. The hinge carriers encircle the framing tube and are free for axial translation along the framing tube. Articulating hinges connect the radius rods to the carrier ribs and to the hinge carriers. Opposed compressed coil springs provide a resilient bias on the hinge carriers to translate the carrier ribs radially outward against the interior surface of a well casing as the tool passes from a riser tube into a larger inside diameter well casing.

13 Claims, 2 Drawing Sheets

(56) References Cited

U.S. PATENT DOCUMENTS

| | | | | |
|---|---|---|---|---|
| 6,595,289 | B2 | 7/2003 | Tumlin et al. | |
| 7,775,272 | B2 * | 8/2010 | Nelson | E21B 17/1028 166/213 |
| 2010/0012312 | A1 * | 1/2010 | Ochoa | E21B 43/103 166/55.8 |
| 2015/0152704 | A1 * | 6/2015 | Tunget | E21B 33/128 166/254.2 |

* cited by examiner

TOTAL CONTROL PERFORATOR AND SYSTEM

CROSS-REFERENCE TO RELATED APPLICATION

Not applicable

BACKGROUND OF THE INVENTION

Field of the Invention

The present invention relates to the industrial art of earth-boring and well drilling for the recovery of fluid minerals. More particularly, the invention relates to a carrier for a multiplicity of shaped explosive charges to penetrate well casing with multiple apertures.

Description of Related Art

In the oil and gas industry, well plugging operations are often performed to seal wellbores in order to abandon the wells. Eventually, all wells exhaust their purpose and are abandoned. Either the well is a "dry hole", having no economically viable production, or has depleted the production strata. In either case, a non-productive well is or should be permanently "plugged". "Plug and abandonment" procedures are required under various state and federal laws and regulations. Plug and abandonment operations performed upon a cased wellbore require that at least a section of the wellbore be filled with cement to prevent the upward movement of fluids toward the surface of the well. To seal the wellbore, a bridge plug is typically placed at a predetermined depth in the wellbore and thereafter, cement is injected into the wellbore to form a column of cement high enough to ensure the wellbore is permanently plugged.

In addition to simply sealing the interior of a wellbore, plug and abandonment regulations additionally require that an area outside of the wellbore be sufficiently blocked to prevent any fluids from migrating towards the surface of the well along the outside of the casing. Migration of fluid outside of the casing is more likely to arise after a fluid path inside the wellbore has been blocked. Additionally, where multiple strings of casing line a wellbore, the annular area between concentric casing strings can form a fluid path in spite of being cemented into place when the well was completed. Inadequate cement jobs and deterioration of cement over time can lead to flow paths being opened through an otherwise solid cement barrier.

There are several reasons to line a well borehole with two or more substantially concentric casings. As one example, two or more mineral strata may be produced from the same borehole. In this example, a smaller diameter casing is set within a larger diameter casing. A first mineral stratum of oil, gas or both, may be produced along the flow annulus between the two casings. A second, usually deeper mineral stratum is produced along the flow bore of the smaller or innermost casing. This sequence may be repeated for multiple pay strata and multiple concentric casings.

Another example of multiple concentric casings is that of extremely deep borings that require a tapered casing string to line an unstable raw borehole along a greater depth than normally expected of a surface casing. In this context, a "tapered" casing string means one in which an inner casing of smaller OD than the ID of an outer casing is secured to the end of the outer casing. Although the surface casing may not penetrate a mineral bearing stratum, the annulus between two concentric casings may carry a flow of gas that has escaped an inner flow bore.

Many off-shore, deep water wells have extremely large surface casings; in the order of 24" ID. These large surface casings are set to a bottom hole depth of 3,000' to 5,000' below the seafloor. The seafloor may be under an ocean depth of 1,000' to 5,000' below a drilling rig floor.

When a well is abandoned, all of the productive flow channels must be filled with cement to a designated depth below the surface or seafloor. In the case of multiple casings, there are two possible approaches available for sealing all of the annuli present. In one approach, as represented by U.S. Pat. No. 5,472,052 to P. F. Head, all of the upper ends of casings that are interior of the outermost casing are milled away down to the designated depth. Thereafter, a solid core of cement is placed to fill the interior volume of the outermost casing. The annulus between the outermost casing OD and the raw borehole ID is filled with cement when originally set.

An alternative well plugging procedure is to set a bridge plug within the innermost casing and perforate the inner casing wall above the plug. Cement is pumped down the inner casing and forced out into the annulus between the inner and outer casings. For multiple annuli, this process is repeated by the selective use of shaped charges that will perforate only the desired number of casing walls but not the outermost casing.

Of the two procedures available for plugging an abandoned well, the latter procedure of casing wall perforation and filling the one or more annuli with cement is more economical by several orders of magnitude. However, deep water offshore wells present unique difficulties for this alternative procedure. When originally drilled, a large drilling platform or drill ship was used to support the immense weights and forces necessary to drill such wells. A "riser" of greater diameter than the largest casing to be set in a particular well links the surface casing to the drilling rig to protect the borehole from invading seawater and as a conduit for the return flow of drilling fluid. When the drilling and well preparation is complete the drilling platform is removed along with the large riser. Smaller and lighter drill ships capable of supporting considerably smaller risers, in the order of 6⅝", are used for well maintenance. By the time of well abandonment, platforms such as was used for the original drilling, are not economically available. In many deep water wells, however, even the smallest or innermost casing is larger than the riser capacity of most maintenance ships.

Casing perforations utilized in a cement "squeezing" operation are typically formed with a perforating assembly that includes a number of shaped charges. An apparatus representative of this concept includes resiliently biased members that remain in contact with the casing wall as the apparatus is lowered into the well. The shaped charges are mounted on the inside surface of bars that are resiliently biased to maintain physical contact with the interior casing wall. The shaped charges are secured at a predetermined distance from the inside bar surface as determined by the casing wall thickness and/or the number of casing walls to be penetrated. An example of such a resiliently biased perforating gun is disclosed in U.S. Pat. No. 5,295,544 to D. V. Umphries. However, the radial expansion distance of a prior art resilient bar is insufficient to accommodate the radial difference between a 6⅝" maintenance ship riser and a 24" casing.

SUMMARY OF THE INVENTION

The present perforating tool provides a variable diameter carrier for multiple perforation charges having the functional capacity of descending along a small inside diameter riser pipe into a larger inside diameter casing. As the carrier enters the larger diameter casing, a bias force on shaped charge carrier ribs expands the ribs into contact with the inside wall surfaces of the larger casing.

The carrier comprises an axially aligned central tube or rod that may be supported at the end of a wire line, tubing or pipe string. Secured to the central rod are two framing discs. Geometric planes respective to the framing discs are typically normal to the central rod axis and are separated by a distance determined by the length of shaped charge carrier ribs.

Along the central rod length on opposite sides of the framing discs are hinge carriers that are confined to the central tube for axial translation along the tube length. Coil springs confined around the central tube bear upon the hinge carriers to resiliently bias the hinge carriers toward each other.

One end of a plurality of radius rods has an articulated connection to the hinge carriers. The opposite end of each radius rod is hinged to a respective end of a shaped charge carrier rib. The opposing bias of the coil springs acting upon the hinge carriers and radius rods imposes resilient radial bias on the shaped charge carrier ribs. The shaped charge carrier ribs are shaped to a substantially rigid section modulus to oppose mid-length bending between the hinges. An outer face of each shaped charge carrier rib is substantially straight between the hinges to physically engage the inside surface of the intended casing. A line of shaped charges is secured along the inside length of the charge carrier ribs at predetermined distances inwardly from the rib outside surface as dictated by the perforation mission.

The shaped charge carrier ribs of an assembled tool are radially compressed against the bias of the coil springs at both ends for transit along the riser bore. As the tool enters a larger ID casing, the coil spring bias expands the charge carrier ribs into contact with the inside casing surface for final placement and discharge of the shaped charges.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DESCRIPTION OF THE PREFERRED EMBODIMENTS

Figure 1:
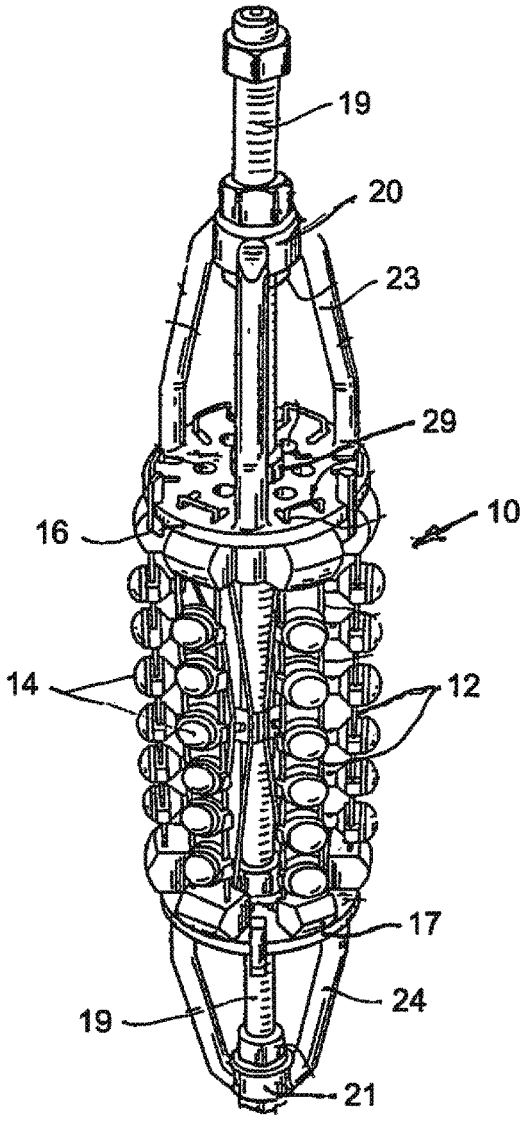
PRIOR ART FIG. 1
FIG. 1 is a pictorial view of a prior art apparatus.

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "rod", "casing", "liner" and/or "other tubular goods" are to be interpreted and defined generically to mean any and all of such elements without limitation of industry usage.

In describing a preferred embodiment of the invention illustrated in the drawings, specific terminology will be resorted to for the sake of clarity. However, the invention is not intended to be limited to the specific terms so selected and it is to be understood that each specific term includes all technical equivalents which operate in a similar manner to accomplish a similar purpose.

With reference to FIG. 1, an example of a prior art casing perforator is shown to comprise six rows of shaped charge carrier ribs 12. Each charge carrier rib may support six shaped charges 14, for example. The six shaped charge carrier ribs 12 are supported between upper and lower framing discs, 16 and 17. A framing rod 19 passes centrally through the framing discs 16 and 17. The framing discs 16 and 17 are secured to upper and lower collars 20 and 21, respectively, by upper and lower legs 23 and 24. The upper and lower collars 20 and 21 ring the framing rod 19. A rigid assembly of collars 20 and 21, the legs 23 and 24, the framing discs 16 and 17 and shaped charge carriers 12 is confined along the length of framing rod 19 between upper and lower compression nuts 26 and 27.

Distinctive of this prior art tool represented by FIG. 1 is provision for compression load against the shaped charge carriers 12. Such compression loading is imposed by preloading nuts 29 (only the upper nut 29 is shown) turned against the respective framing discs 16 and 17. Compression load at opposite ends of the shaped charge carriers 12 effects a resiliently arced position to the carriers thereby forcing a bias on the shaped charges 14 against the inside surface of a surrounding casing.

Although the prior art tool described by FIG. 1 is effective for use with a casing of known size having direct accessibility, compliance to casing size variation is extremely limited; a limitation the present invention is intended to overcome.

Figure 2:
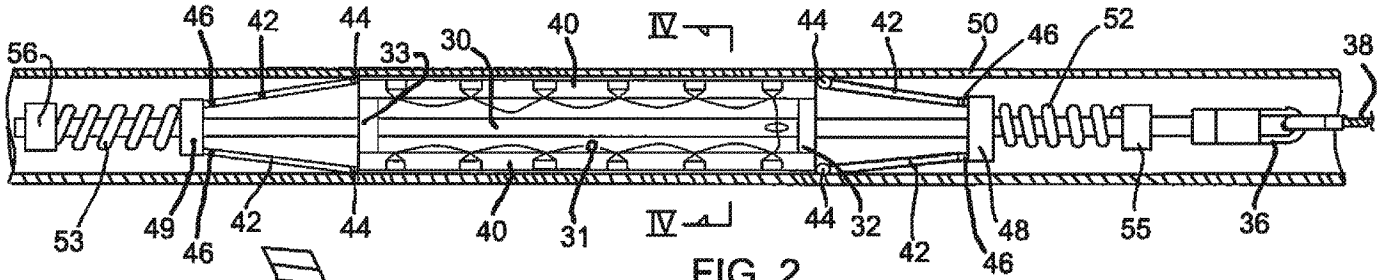
FIG. 2 is a partial section view of the invention in a collapsed assembly mode.
Figure 5:
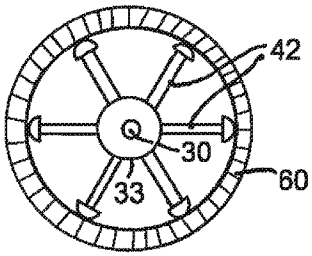
FIG. 5 is a section view of the invention along cutting plane V-V of FIG. 3.
Figure 4:
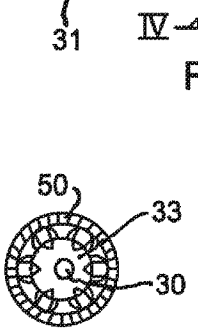
FIG. 4 is a section view of the invention along cutting plane IV-IV of FIG. 2.

Referring to the partial sections of FIGS. 2 and 4, the present invention is shown in a radially constricted mode as configured to traverse the length of a small diameter riser pipe 50. Central to the tool construction is a framing rod or tube 30 preferably having a hollow bore to carry detonation cord 31. A bail 36 may secured to the upper end of the framing tube for attachment of a suspension wireline 38. In a mid-section of the framing tube, upper and lower framing discs, 32 and 33 respectively, are secured at selected axial positions along the framing tube 30 length. The outer perimeter of the framing discs 32 and 33 set constrictive limit stops for a plurality of shaped charge carrier ribs 40.

Figure 3:
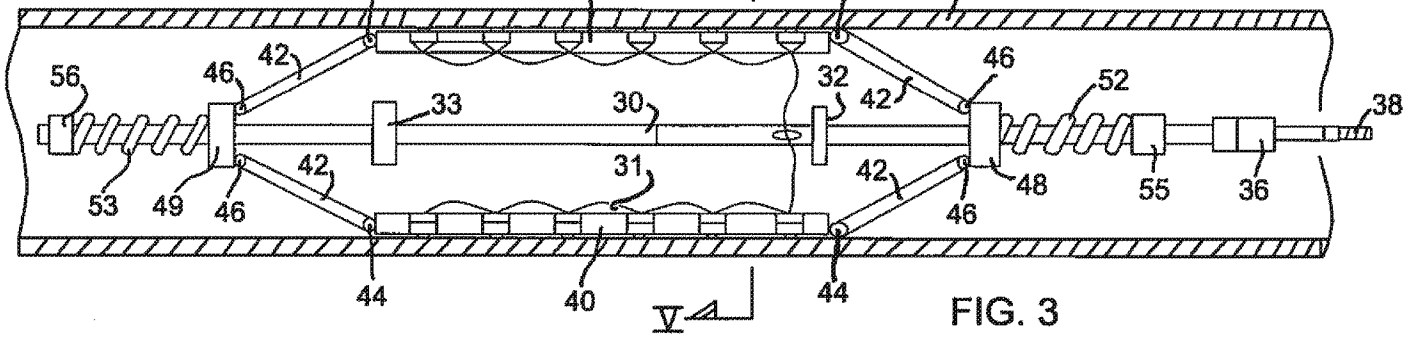
FIG. 3 is a partial section view of the invention in an expanded assembly mode.

The shaped charge carrier ribs 40 are secured to the central framing tube 30 by a translational linkage that will maintain a substantial parallelism between the ribs 40 as the are translated from a first constricted circumference to greater circumference in abutted engagement with the inner walls of a larger ID casing. Although only two shaped charge carrier ribs 40 are illustrated by FIGS. 2 and 3 as a diametric pair, it should be understood the tool will normally be provided with four to eight such shaped charge carrier ribs. Consequently, the axial separation between the framing discs 32 and 33 should be no greater than the length of the shaped charge carrier ribs 40 but may be somewhat less.

A preferred embodiment of a suitable translating linkage mechanism may include an articulated joint or hinge 44 secured at opposite distal ends of each shaped charge carrier rib 40. One distal end of a tie rod 42 is secured to a carrier rib 40 by an articulated joint or hinge 44 and the opposite distal end of the tie rod 42 is secured to an upper or lower hinge carrier 48 or 49 by an articulated joint or hinge 46. The hinge carriers 49 are radially confined around the framing tube 30 but are freely translated along the tube length. Upper and lower coil springs 52 and 53, respectively, are compressed between the hinge carriers 48 and 49 and upper and lower base rings 55 and 56 for a passively resilient displacement force on the rib 40 articulation linkage.

Viewing FIGS. 2 and 3 comparatively, it may be seen that when the tool passes from the smaller diameter bore of the riser 50 into a casing 60 of greater diameter, the expanding bias of springs 52 and 53 displace hinge carriers 48 and 49 along the framing tube 30 in mutually opposite directions. Hinge carrier displacement is transferred to the tie rod hinges 46 which are confined to a fixed radial separation distance from the framing tube 30. Consequently, the interior ends of the fixed length tie rods 42, hinged to the shaped charge carrier ribs 40, displace the shaped charge carrier ribs from contact with the framing discs 32 and 33 and radially out against the inside surface of the greater diameter casing 60.

Figure 6:
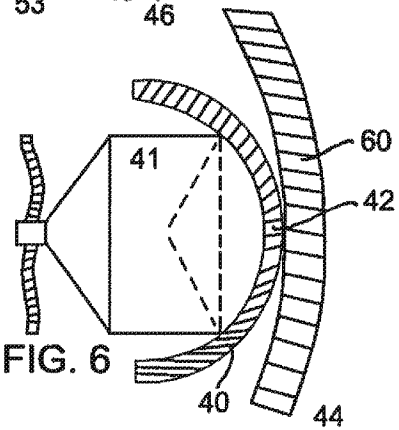
FIG. 6 is a sectioned detail of a shaped charge carrier rib.

The enlarged detail of FIG. 6 illustrates a representative shaped charge 41 secured within the inside arc of a shaped charge carrier rib 40 having a cross-sectional shape configured to high bending modulus. An aperture 42 is formed in the apex of the carrier in line with the discharge axis of the shaped charge 41. The spring driven bias on the shaped charge carrier rib 40 presses the rib apex line into tangent contact with the inside surface of the casing 60. Shaped charge penetration depth may be adjusted by a controlled separation distance between the contact face of the carrier rib and the discharge face of the shaped charge.

Those of ordinary skill in the art will also understand that section shapes having a high bending modulus other than the half cylinder arc of carrier rib 40 may also be used. A channel section rib is an example. Box sections, rectangular sections and 90° angle sections may also be used.

It is important that the casing perforations opened by the present tool are limited to the one or more intended interior casings and exclusive of the outermost well casing. Skilled selection of shaped charge penetration depth, capacity and configuration considers the casing wall thickness and annulus separation between the walls. This selection process is assisted by a controlled separation distance of a shaped charge discharge face from the inside surface of the casing. The present invention facilitates such controlled separation distance.

Among relevant tool design criteria is the length of the tie rods 42 as it affects the expanded angle of the rods. After discharge, the tool is usually withdrawn from the wellbore back through the riser 50. As the tool passes through the transition point between the casing and riser, the shaped charge carrier rib ends attached to the upper tie rods 42 are forced inwardly toward the framing tube 30. Consequently, the upper hinge carrier 48 translates upwardly against the bias of upper spring 52. Such compressive force on the spring 52 translates to the tensile force drawn on the wireline 38.

Figure 7:
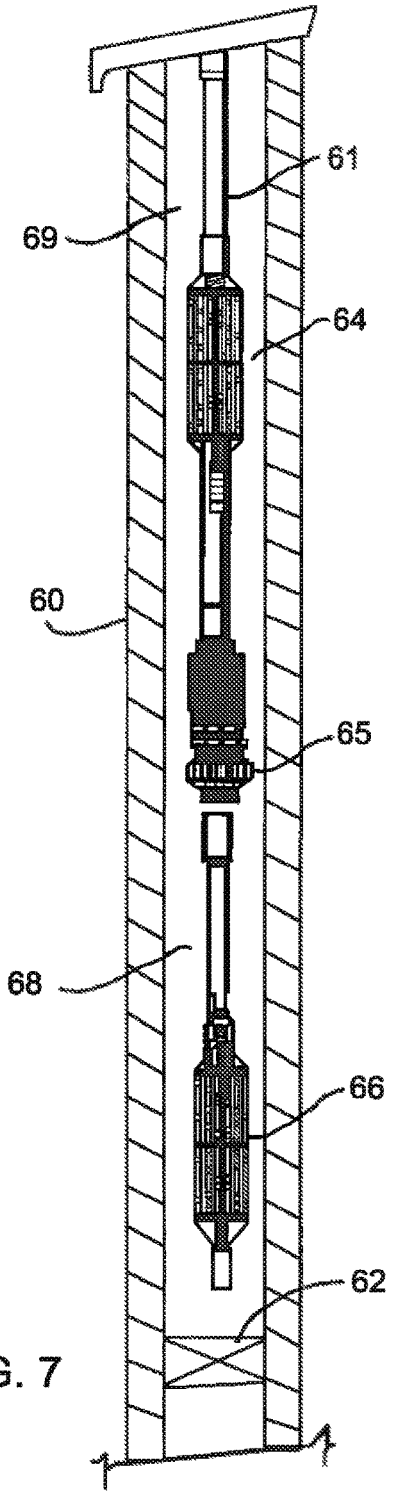
FIG. 7 is a profile view of a particular utility of the invention.

In a different application, two of the present perforating tools 64 and 66 may be secured at the end of a suspension pipe or tubing string 61 with a bore packer 65 attached between the two as illustrated by FIG. 7 to verify the seal integrity of cement annulus around a casing. A bridge plug 62 is set to seal the bore of a subject casing 60 to be tested for integrity of a cement annulus seal around the subject casing 60. The FIG. 7 tool assembly is positioned above the bridge plug 62. The packer 65 is expanded to seal the annulus 69 between the casing 60 ID and the suspension tube 61 OD. The lowermost perforating tool 66 is now confined in a pressure retention zone 68 between the bridge plug 62 and the packer 65.

Discharge of the two perforating tools 64 and 66 opens apertures through the casing 60 into the surrounding cement sealing collar. From the surface, fluid is pumped through the suspension tube 61 into the pressure retention zone 68. Simultaneously, pressure within the annulus 69 between the casing 60 ID and the suspension tube 61 OD above the packer 65 is monitored. An increase in annulus fluid pressure above the packer 65 is an indication of leakage and fluid migration past the cement sealing collar around the subject casing 60 OD, Those of ordinary skill will also quickly appreciate a wheeled adaption of the invention for use in deviated or horizontal well bore directions. Such wheeled embodiments may be by directly attached axles or fore and aft accessory carriages.

The foregoing description of the invention represents a fundamental, self-actuating embodiment having a standing resilient expansion bias on the charge carrier ribs imposed by a pair of identical coil springs 52 and 53. Hence, the tool has no dependency on remote controls or power sources to engage and disengage inside diameter surfaces of larger casings. However, numerous alternative mechanisms are also well known to the prior art.

Non-illustrated examples of mechanisms that are generally equivalent to the coil springs 52 and 53 may include pneumatic, oleo-pneumatic and hydraulic piston/cylinder devices operating as direct substitutes for the coil springs 52 and 53.

Charge carrier ribs 40 may be expanded by numerous translational mechanisms other than the radius rods 42 described herein. For example, an opposed scissors mechanism similar to a lifting jack may be particularly useful in certain applications to translate the charge carrier ribs radially against a casing ID.

Another example of the invention may position the radius rods and hinge carriers between the charge carrier ribs and the central tube with a resilient force such as springs between the hinge carriers.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A pipe perforating tool comprising:

an axially elongated central tube;

a plurality of elongated ribs substantially evenly distributed circumferentially around said central tube;

a plurality of explosive shaped charges secured along each said rib for discharge along an axis substantially normal to said central tube axis;

a first linkage between said central tube and one end of said elongated ribs, and a second linkage between said central tube and an opposite end of said elongated ribs;

a first displacement force bearing upon said first linkage in a direction toward the second linkage, and a second displacement force bearing upon said second linkage in a direction toward the first linkage, to automatically radially translate said elongated ribs from a first position at a first radial distance from said central tube where said ribs are substantially parallel with said central tube to a second position at a second radial distance from said central tube that is greater than said first radial distance where said ribs remain substantially parallel with said central tube; and at least one stop secured on the central tube to prevent the ribs from contacting the central tube in the first position, wherein the at least one stop extends perpendicularly from the central tube.

2. The pipe perforating tool described by claim 1 wherein said ribs are translated to longitudinal contact with an inside bore surface of a well pipe.

3. The pipe perforating tool described by claim 1 wherein at least one of said first linkage and said second linkage comprises a radius rod secured by an articulation joint to an end of each elongated rib.

4. The pipe perforating tool described by claim 3 wherein the radius rod is also secured by an articulated joint to a hinge carrier.

5. The pipe perforating tool described by claim 4 wherein said hinge carrier is secured to said central tube for axial translation along said central tube.

6. The pipe perforating tool described by claim 4 wherein said first displacement force and said second displacement force each comprises a spring bearing upon said hinge carrier.

7. The pipe perforating tool described by claim 1 wherein the plurality of explosive shaped charges are arranged at predetermined locations on each elongated rib, and the predetermined locations are the same for each elongated rib.

8. The pipe perforating tool described by claim 1 wherein the at least one stop comprises a first stop and a second stop that are separated from each other along the central tube axis by a distance that is not greater than an overall length of each one of the elongated ribs.

9. A method of perforating a well pipe wall comprising the steps of:

providing a perforating tool with an axially elongated central tube and a plurality of substantially equal length ribs;

distributing said ribs substantially equally around a circumference of the central tube in substantially parallel alignment with said central tube;

securing a plurality of shaped explosive charges along the length of each of said ribs, said shaped explosive charges aligned to discharge radially along an axis substantially normal to said central tube axis;

providing a first linkage between said central tube element one end of said ribs, and a second linkage between said central tube and an opposite end of said ribs;

providing a first displacement force from a resilient bias on said first linkage in a direction toward the second linkage, and providing a second displacement force from a resilient bias on said second linkage in a direction toward the first linkage, to automatically radially translate the parallel ribs out from a first position at a first radial distance from said central tube where said ribs are substantially parallel with said central tube to a second position at a second radial distance from said central tube that is greater than said first radial distance where said ribs remain substantially parallel with said central tube and engage inside walls of a well pipe;

securing at least one stop on the central tube so that the at least one stop extends perpendicularly from the central tube, the at least one stop for preventing the ribs from contacting the central tube in the first position;

suspending said perforating tool at the end of a suspension string within a well pipe; and discharging said shaped explosive charges to perforate said well pipe walls.

10. The method of perforating a well pipe wall described by claim 9 wherein said linkage provides a hinge carrier that is secured to said central tube for translational displacement along said central tube.

11. The method of perforating a well pipe wall described by claim 10 wherein said linkage provides a radius rod having a hinged connection of one end to a rib and a hinged connection of an opposite end to said hinge carrier.

12. A method of perforating a well casing served by a riser tube of lesser inside diameter than said well casing, said method comprising the steps of:

providing a perforating tool having an axially elongated central tube and a plurality of parallel ribs positioned evenly around the circumference of the central tube;

securing one or more shaped explosive charges along a length of each parallel rib for discharge along an axis substantially normal to said central tube axis;

providing a first linkage to secure one end of each parallel rib to said central tube, and a second linkage to secure an opposite end of each parallel rib to said central tube;

providing a first displacement force from a first resilient bias on said first linkage in a direction toward the second linkage, and a second displacement force from a second resilient bias on said second linkage in a direction toward the first linkage, for automatic translation of said parallel ribs radially out from a first position at a first radial distance from said central tube where said ribs are substantially parallel with said central tube to a second position at a second radial distance from said central tube that is greater than said first radial distance where said ribs remain substantially parallel with said central tube;

securing at least one stop on the central tube so that the at least one stop extends perpendicularly from the central tube, the at least one stop for preventing the ribs from contacting the central tube in the first position;

radially contracting said parallel ribs for descent of said perforating tool along a length of a riser tube;

radially expanding said parallel ribs against the inside bore wall of a well casing served by said riser tube upon entry, by said perforating tool; and detonating one or more of said shaped explosive charges.

13. The method described by claim 12 wherein said linkage maintains substantial parallelism of said ribs when radially expanded.

* * * * *